US005947362A

United States Patent [19]

Omli

[11] Patent Number: 5,947,362

[45] Date of Patent: Sep. 7, 1999

[54] FASTENER DRIVER CAP FEEDER ASSEMBLY

[76] Inventor: Allan T. Omli, 340 Steed Ct., Winston-Salem, N.C. 27104

[21] Appl. No.: 08/947,573

[22] Filed: Oct. 9, 1997

[51] Int. Cl.[6] ..... B25C 5/00

[52] U.S. Cl. ..... 227/120

[58] Field of Search ..... 227/8, 130, 135, 227/136, 137, 18, 15, 16, 120, 138

[56] References Cited

U.S. PATENT DOCUMENTS

| | | |
|---|---|---|
| 4,657,167 | 4/1987 | May . |
| 4,932,580 | 6/1990 | Pfister et al. . |
| 4,998,662 | 3/1991 | Hasan et al. . |
| 5,042,142 | 8/1991 | Beach . |
| 5,056,684 | 10/1991 | Beach et al. . |
| 5,069,340 | 12/1991 | Ernst et al. . |
| 5,193,729 | 3/1993 | Dewey et al. . |
| 5,267,682 | 12/1993 | Okouchi . |
| 5,484,094 | 1/1996 | Gupta . |

*Primary Examiner*—Jessica J. Harrison
*Assistant Examiner*—John Paradiso
*Attorney, Agent, or Firm*—John M. Harrington; Kilpatrick Stockton LLP

[57] ABSTRACT

A fastener driver cap feeder assembly includes a nose piece adapted to be attached to a pneumatic or explosive charge type fastener driver for receiving and supporting a fastener cap proximate a nose of the fastener driver for the pupose of driving a fastener through the fastener cap into a workpiece. The assembly also includes a track communicating with the nose piece and adapted to direct succeeding fastener caps to the nose piece, a magazine adapted to receive and hold a supply of succeeding fastener caps and communicating with the track to permit passage of succeeding fastener caps from the magazine to the track, and an intermittently operable mechanism associated with one of the track and the magazine adapted to operate in response to actuation of the fastener driver to incrementally move succeeding fastener caps from the track to the nose piece. The intermittently operable mechanism may be associated with the track and includes a spring biased feed trigger or a piston activated feed finger which engages one of the fastener caps in response to actuation of the fastener driver and incrementally moves succeeding fastener caps toward the nose piece. Alternatively, the intermittently operable mechanism may be associated with the magazine and includes a spring disposed in the magazine adapted to urge the supply of fastener caps toward the track and in turn to urge succeeding fastener caps toward the nosepiece in response to actuation of the fastener driver.

44 Claims, 6 Drawing Sheets

FASTENER DRIVER CAP FEEDER ASSEMBLY

BACKGROUND OF THE INVENTION

1. Field of the Invention

The present invention relates in general to pneumatic or explosive charge type fastener drivers, and in particular, to a fastener cap feeder assembly for a fastener driver.

2. Description of the Prior Art

The use of a conventional pneumatic or explosive charge type fastener driver to drive a nail into a substrate is well known in the prior art. However, in fastening a sheet-like material such as roofing, felt, sheathing, house wrap, or the like to the substrate, it may be desirable or necessary to use a fastener cap with the nail, for example, to securely fasten the sheet-like material to the substate without damaging the sheet-like material and to minimize seepage of moisture beneath the sheet material. It is impractical, if not impossible, to use a fastener driver for such purpose. Rather, the fastener cap must first be applied to the nail by manually inserting the shaft of the nail through a central opening formed in the fastener cap and thereafter manually driving the nail through the sheet material into the substrate with a tool such as a hammer.

Accordingly, there is a present need for a fastener cap feeder assembly for use with a pneumatic or explosive charge type fastener driver to feed a succession of fastener caps to a position such that when a fastener is ejected by the fastener driver, the shaft of the fastener is driven through the fastener cap and through the sheet material into a substrate.

SUMMARY OF THE INVENTION

The present invention addresses this need and provides a fastener cap feeder assembly for use with a fastener driver which utilizes a nose-piece to support a fastener cap in a position between the nose of the fastener driver and the sheet material such that when a nail is ejected from the nose of the fastener driver, the shaft of the nail is driven through the fastener cap and through the sheet material into the substrate. The fastener driver includes a spring biased assembly associated with the nose of the fastener driver which is normally biased away from the nose and which must be pressed inwardly toward the nose by pressing the spring biased assembly against the substrate in order to actuate the fastener driver for ejecting and driving the nail. The nose piece of the fastener cap feeder assembly is attached to the spring biased assembly of the fastener driver proximate the nose of the fastener driver, such that the nose piece is interposed between the nose of the fastener driver and the sheet material to be fastened to the substrate. Thus, in order to actuate the fastener driver, the spring biased assembly of the fastener driver is pressed inwardly by pressing the nosepiece of the fastener cap feeder assembly against the sheet material rather than by pressing the spring biased assembly of the fastener driver directly against the sheet material. The nose piece is provided with a support member for supporting the fastener cap, and an aperture to permit passage of the nail and the fastener cap when the nail is ejected from the nose of the fastener driver. When the nail is ejected from the fastener driver, the fastener cap is driven with the nail from the nose piece and replaced by one of a plurality of succeeding fastener caps from a fastener cap guide means in the form of a track. For this purpose, the nose piece is provided with an open side communicating with an end of the track to permit passage of succeeding fastener caps from the track to the nose piece. The nose piece may be provided with a stop to arrest movement of the succeeding fastener cap. The track is elongate and defined generally as a channel with a somewhat U-shaped cross section and an open top with one end of the track communicating with the open side of the nose piece and an opposite end communicating with a fastener cap supply magazine. The magazine has portions defining an opening which permits passage of succeeding fastener caps from the supply of fastener caps held in the magazine to the end of the track to be guided to its other end for passage to the nose piece.

In order to move succeeding fastener caps into the nose piece from the track, a fastener cap moving mechanism is provided which is intermittently operable in response to actuation of the fastener driver to incrementally move the succeeding fastener caps along the track. The fastener cap moving mechanism makes use of a feed trigger disposed proximate the open top of the track with an end extending through the open top of the track into the channel defined by the substantially U-shaped cross section of the track. The feed trigger is movable between a forward position towards the end of the track adjacent the nosepiece and a rearward position away from the end of the track adjacent the nose piece and is normally spring biased to the forward position. The feed trigger is connected to an end of a feed lever which has an opposing end pivoted to the fastener driver. The feed lever is pivotable in response to movement of a link connected to the spring biased assembly of the fastener driver, which movement is transmitted to the feed lever through a cam roller of the link. When the spring biased assembly of the fastener driver is pressed inwardly toward the nose of the fastener driver by pressing the nose piece of the fastener cap feeder assembly against the sheet material to actuate the fastener driver, the link connected to the spring biased assembly acts on the feed lever through the cam roller. In turn, the feed lever connected to the feed trigger acts on the feed trigger to move the feed trigger from its normally disposed forward position to its rearward position away from the end of the track adjacent the nose piece. In order to enable rearward movement of the feed trigger without moving one of the succeeding fastener caps rearward with it, the feed trigger is arranged to allow it to be pivoted upward away from the track to ride over the upper surface of a succeeding fastener cap as the feed trigger is moved to its rearward position. The feed trigger is spring biased to pivot downward after riding over the succeeding fastener cap in order for the end of the feed trigger extending into the track to engage the succeeding fastener cap. Upon actuation of the fastener driver, the nail is ejected and driven from the nose of the fastener driver, in turn driving the fastener cap from the nose piece. After actuation of the fastener driver, the spring biased assembly of the fastener driver is allowed to return to its normally disposed spring biased position away from the nose of the fastener driver, whereupon the cam roller of the link no longer acts on the feed lever, and the feed trigger is allowed to return to its normally disposed spring biased forward position. As the feed trigger moves to its forward position, the end of the feed trigger extending into the track moves the succeeding fastener cap forward toward the end of the track adjacent the nose piece an incremental distance equal to about or slightly greater than the diameter of the succeeding fastener cap.

The supply of fastener caps held in the magazine is provided in the form of an assemblage of fastener caps held in fixed relationship to one another. The assemblage of fastener caps takes the form of a plurality of fastener caps releaseably connected to one another in a continous strip by at least one breakable member disposed on a marginal edge of each fastener cap. Alternatively, the assemblage of fastener caps may be held in fixed relationship to one another by releasably attaching each to a carrier member in the form of a release strip rather than connecting the fastener caps directly to one another. Each of the fastener caps has a generally concave bottom surface and a generally convex upper surface with a substantially centrally disposed recess formed in the upper surface to receive the head of the nail when the shaft of the nail is driven through the opening of the fastener cap. The opening of the fastener cap is likewise substantially centered within the recess to receive the shaft of the nail when the nail is ejected and driven from the nose of the fastener driver. The feed trigger is operable to be moved to its rearward position upon pressing inwardly on the spring biased assembly of the fastener driver in order to actuate the fastener driver. Upon actuation of the fastener driver, the shaft of the nail is driven through the opening of the fastener cap with sufficient force to break the breakable member and to separate the fastener cap from the assemblage of fastener caps, and the fastener cap is carried from the support member through the aperture of the nose piece by the nail. After actuation, the spring biased assembly of the fastener driver is allowed to return to its normally disposed position, whereupon the feed trigger is likewise allowed to return to its spring biased forward position, thereby moving one of the succeeding fastener caps forward an incremental distance toward the end of the track adjacent the nose piece and thus moving the entire assemblage of fastener caps a like distance forward in the track toward the nose piece. Thus, the feed mechanism is operable in response to such actuation to move the assemblage of fastener caps toward the nose piece an incremental distance that is sufficient to move one of the succeeding fastener caps from a position in the track adjacent the nose piece through the open side of the nose piece to a position supported on the support member of the nose piece. Accordingly, with each actuation of the fastener driver, the assemblage of fastener caps is moved an incremental distance in the track toward the nose piece and away from the magazine, such that succeeding fastener caps are continually drawn from the supply of fastener caps in the magazine. When the supply of fastener caps is fully drawn from the magazine, a fresh supply can be inserted in the interior of the magazine through the access opening of the magazine.

The fastener cap moving mechanism may alternatively make use of a feed finger disposed proximate the open top of the track with an end of the feed finger extending through the open top of the track into the channel defined by the substantially U-shaped cross section of the track. The feed finger is moveable between a forward position toward the end of the track adjacent the nose piece and a rearward position away from the end of the track adjacent the nose piece by means of a double action pneumatic piston actuated by a switch. The feed finger is mounted on the pneumatic piston and is normally held in the forward position by extension of the piston toward the end of the track adjacent the nose piece. The switch is operable in response to movement of a rod connected to the spring biased assembly of the fastener driver. When the spring biased assembly of the fastener driver is pressed inwardly toward the nose of the fastener driver by pressing the nose piece of the fastener cap feed assembly against the sheet material to actuate the fastener driver, the rod connected to the spring biased assembly of the fastener driver operates the switch to actuate the piston to retract in a direction away from the end of the track adjacent the nose piece, thereby moving the feed finger from its normally disposed forward position to its rearward position away from the end of the track adjacent the nose piece. Likewise, in order to enable rearward movement of the feed finger without moving one of the succeeding fastener caps with it, the feed finger is arranged to allow it to be pivoted upward away from the track to ride over the upper surface of a succeeding fastener cap as the feed finger is moved to its rearward position. Further, the feed finger is spring biased to be pivoted downward after riding over the succeeding fastener cap in order for the end of the feed finger extending into the track to engage the succeeding fastener cap. Upon actuation of the fastener driver, the nail is ejected and driven from the nose of the fastener driver, in turn driving the fastener cap from the nose piece. After actuation of the fastener driver, the spring biased assembly is allowed to return to its normally disposed position away from the nose of the fastener driver, whereupon the rod operates the switch to actuate the piston to its extended position, thereby returning the feed finger to its normally disposed forward position. As the feed finger moves toward its forward position, the end of the feed finger extending through the open top of the track moves the succeeding fastener cap forward toward the end of the track adjacent the nose piece an incremental distance equal to about or slightly greater than the diameter of the fastener cap, thus moving the entire assemblage of fastener caps a like distance forward in the track toward the nose piece. Likewise, with each actuation of the fastener driver, the assemblage of fastener caps is moved an incremental distance in the track toward the nose piece and away from the magazine, such that one of the succeeding fastener caps is moved from the track to the nose piece.

Preferably, the assemblage of fastener caps is held in a canister-like magazine in the form of a plurality of fastener caps releasably connected to one another in a continuous strip which can be wound about a central axis in concentric layers with an inner end disposed at the center and an outer end which is threaded through an opening of the magazine to an end of the track adjacent the magazine. The fastener cap moving mechanism may make use of a clock-type winding spring associated with the magazine, which engages the assemblage of fastener caps held in the magazine. The spring can be manually wound such that as it subsequently unwinds, it urges the assemblage of fastening caps to rotate relative to the magazine, thereby urging the outer end of the assemblage forward in the track toward the nose piece of the fastener cap feeder assembly until forward movement of the assemblage is arrested by the stop of the nose piece with a fastener cap supported on the support member. When the fastener driver is actuated to eject the nail from the nose of the fastener driver, thereby driving the fastener cap from the nose piece, the spring acting on the assemblage of fastener caps held in the magazine urges the assemblage of fastener caps forward in the track, thereby moving a succeeding fastener cap forward from the track to the nose piece a distance about equal to or slightly greater than the diameter of the fastener cap until its forward movement is arrested by the stop of the nose piece.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways. It is to be further understood that the phraseology and terminology employed herein are for the purpose of description and are not to be considered as limiting. Those skilled in the art will appreciate that the conception on which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a fastener cap feeder assembly which can be used with a fastener driver to position a fastener cap proximate the nose of the fastener driver in order to drive a fastener cap from the fastener driver through the fastener cap into a substrate.

It is another object of the present invention to provide a fastener cap feeder assembly which directs succeeding fastener caps to the nose of the fastener driver.

Yet another object of the present invention is to provide a fastener cap feeder assembly which holds a supply of succeeding fastener caps to be directed to the nose piece of the fastener driver.

Still another object of the present invention is to provide a fastener cap feeder assembly which moves succeeding fastener caps from a supply of succeeding fastener caps to the nose piece of the fastener driver.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which like characters of reference designate like parts through the several views.

BRIEF DESCRIPTION OF THE DRAWINGS

This invention will be better understood and objects other than those set forth above will become apparent when consideration is given to the following detailed description. Such description makes reference to the annexed drawings wherein.

DETAILED DESCRIPTION OF THE DRAWINGS

Figure 1:
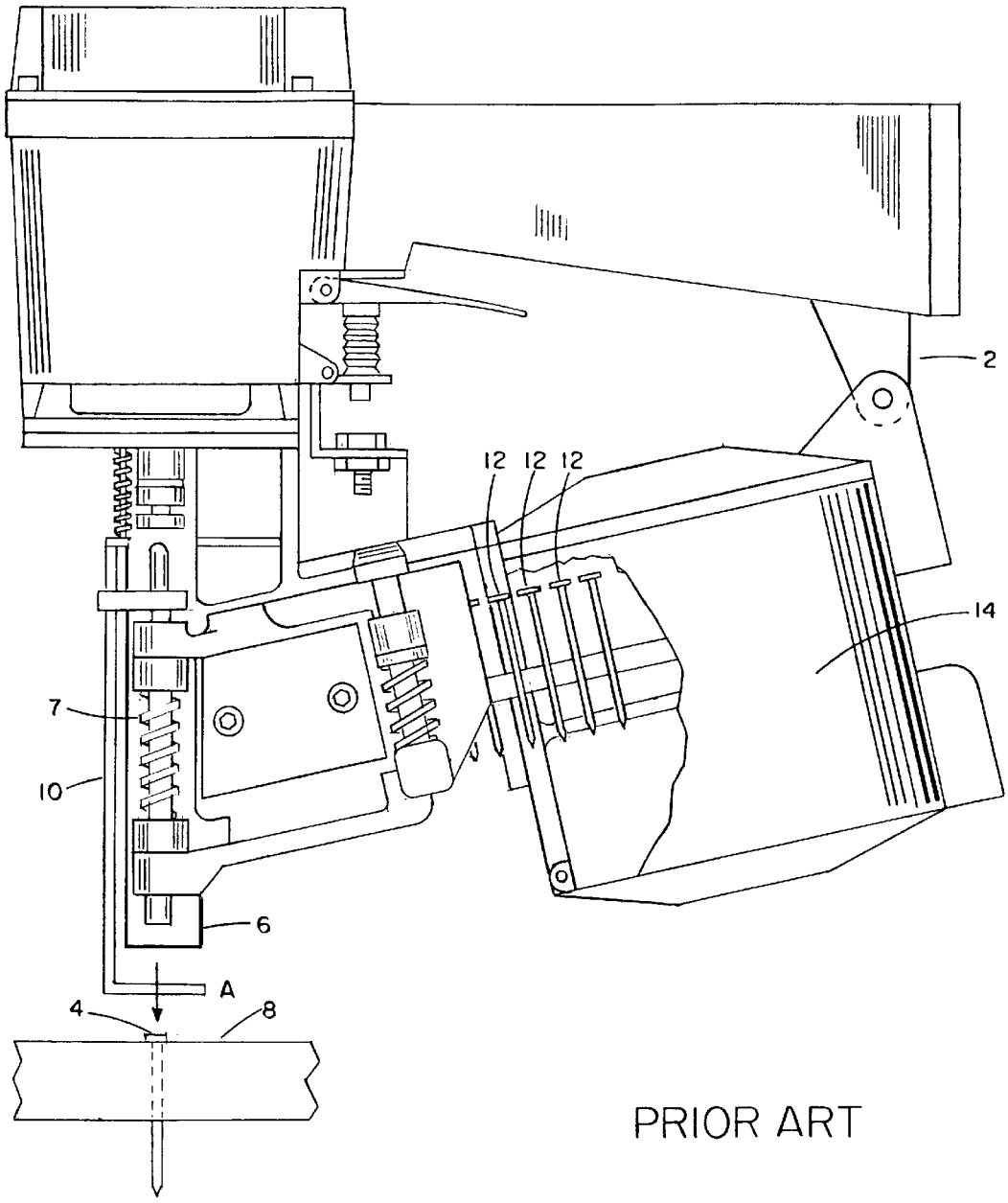
FIG. 1 is a side elevational view of a conventional prior art fastener driver.
Figure 2:
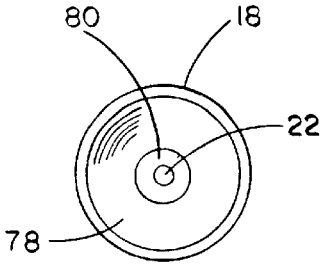
FIG. 2 is a top view of a fastener cap for use in connection with the fastener cap feeder assembly of the present invention.
Figure 3:
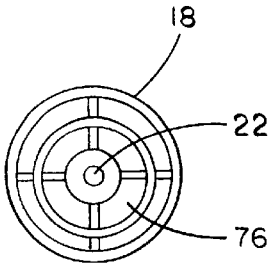
FIG. 3 is a bottom view of the fastener cap of FIG. 2.
Figure 4:
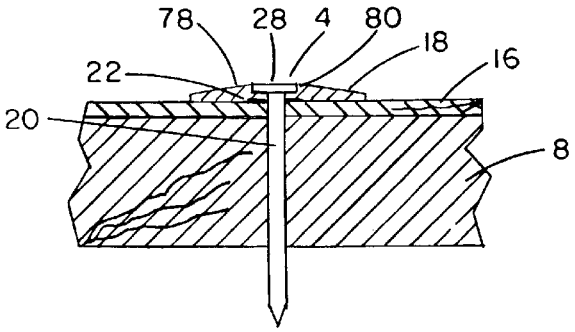
FIG. 4 is a sectional view of the fastener cap of FIG. 2 shown with a nail driven through the fastner cap into a substrate.

As shown in FIG. 1, a conventional pneumatic or explosive charge type fastener driver 2 is used to eject a fastener such as a nail 4 from a nose 6 of barrel 7 of the fastener driver 2 and to drive the nail 4 into a substrate 8 of material such as wood, particle board or the like. The fastener driver 2 includes a spring biased assembly 10 associated with nose 6 which is normally biased away from nose 6 and which must be pressed inwardly toward nose 6 by pressing spring biased assembly 10 against substrate 8 in order to actuate the fastener driver 2 for ejecting and driving the nail 4. A supply of succeeding nails 12 is fed from a fastener driver magazine 14 which holds the supply of nails 12 for that purpose. When nail 4 is ejected from nose 6 of fastener driver 2, a succeeding nail is fed from the supply of nails 12 held in magazine 14 for the purpose of being ejected from nose 6 and driven in the same manner. Referring to FIGS. 2–4, in fastening a sheet-like material 16 such as roofing, felt, sheathing, house wrap or the like to substrate 8, it is necessary to use a fastener cap 18 with nail 4, for example, to securely fasten the sheet material 16 to substrate 8 without damaging the sheet material and to minimize seepage of moisture beneath sheet material 16. It is impractical, if not impossible, to use fastener driver 2 for this purpose. Rather, fastener cap 18 is first applied to nail 4 by manually inserting shaft 20 of nail 4 through a central opening 22 formed in fastener cap 18 and thereafter manually driving nail 4 through sheet material 16 into substrate 8 with a tool such as a hammer (not shown).

Figure 5:
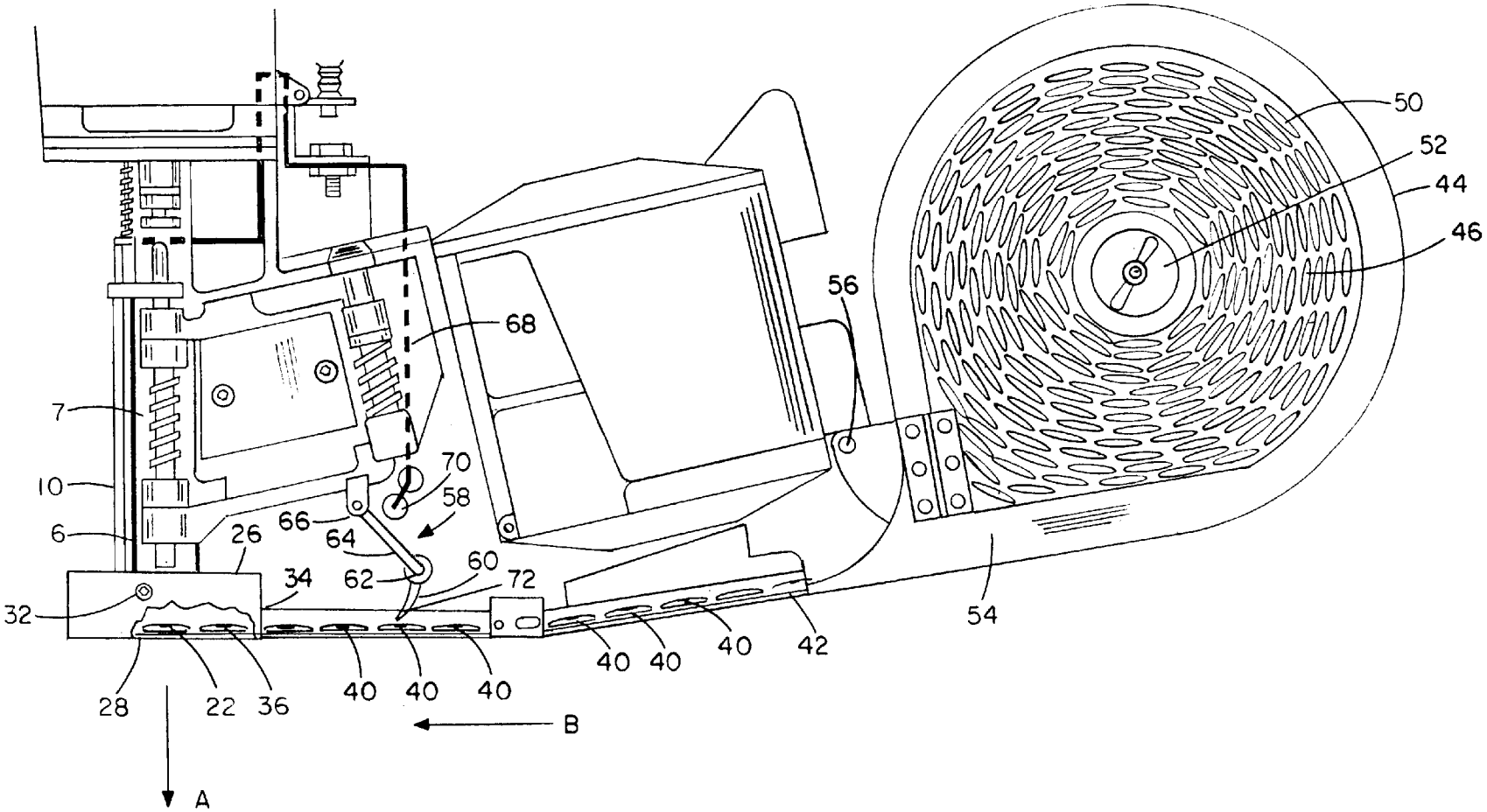
FIG. 5 is a side elevational view of a fastener cap feeder assembly in accordance with the present invention attached to the fastener driver as shown in FIG. 1.
Figure 6:
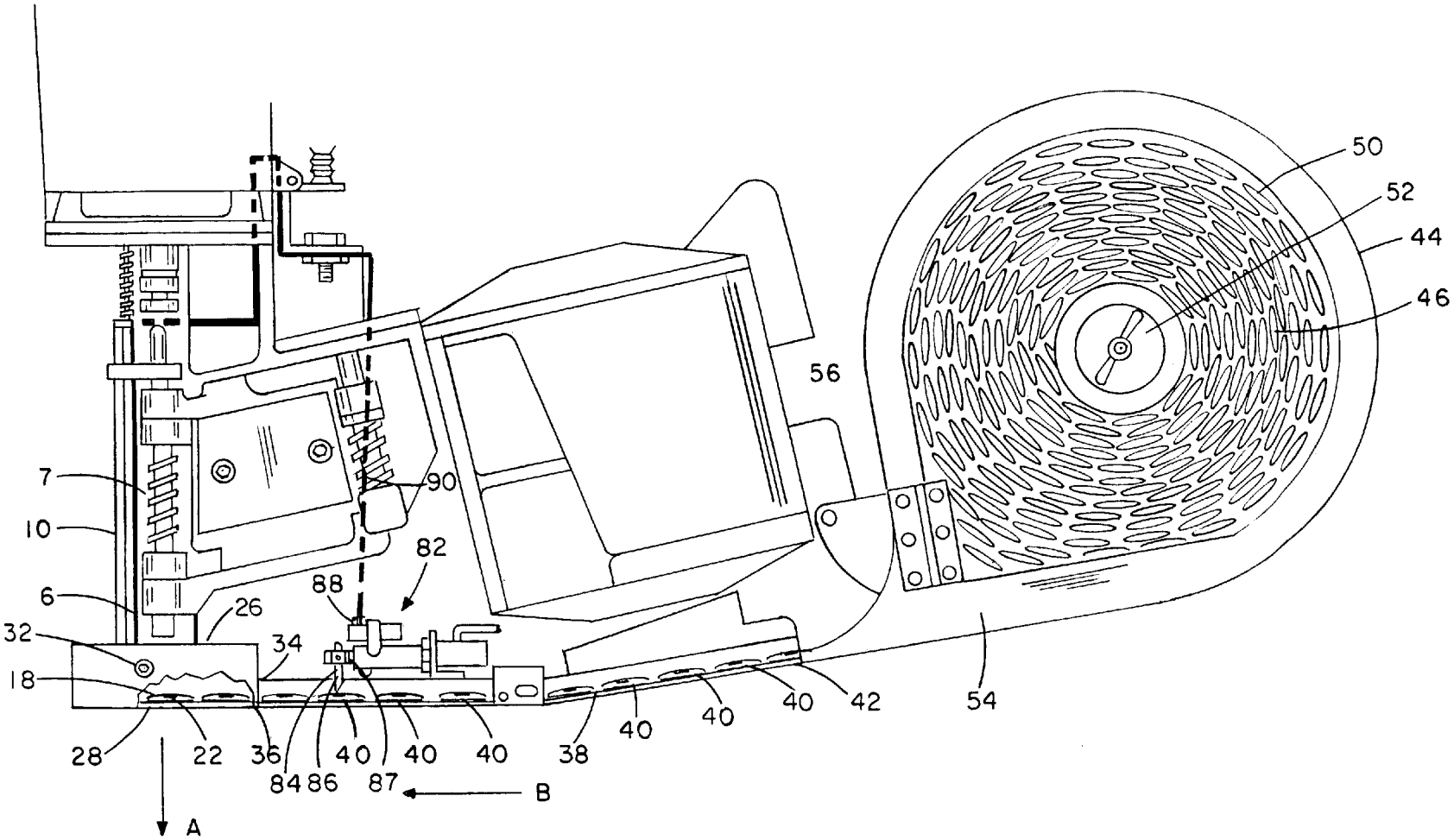
FIG. 6 is a side elevational view of a fastener cap feeder assembly in accordance with the present invention attached to the fastener driver of FIG. 1 and with an alternate embodiment feeder cap moving mechanism.
Figure 7:
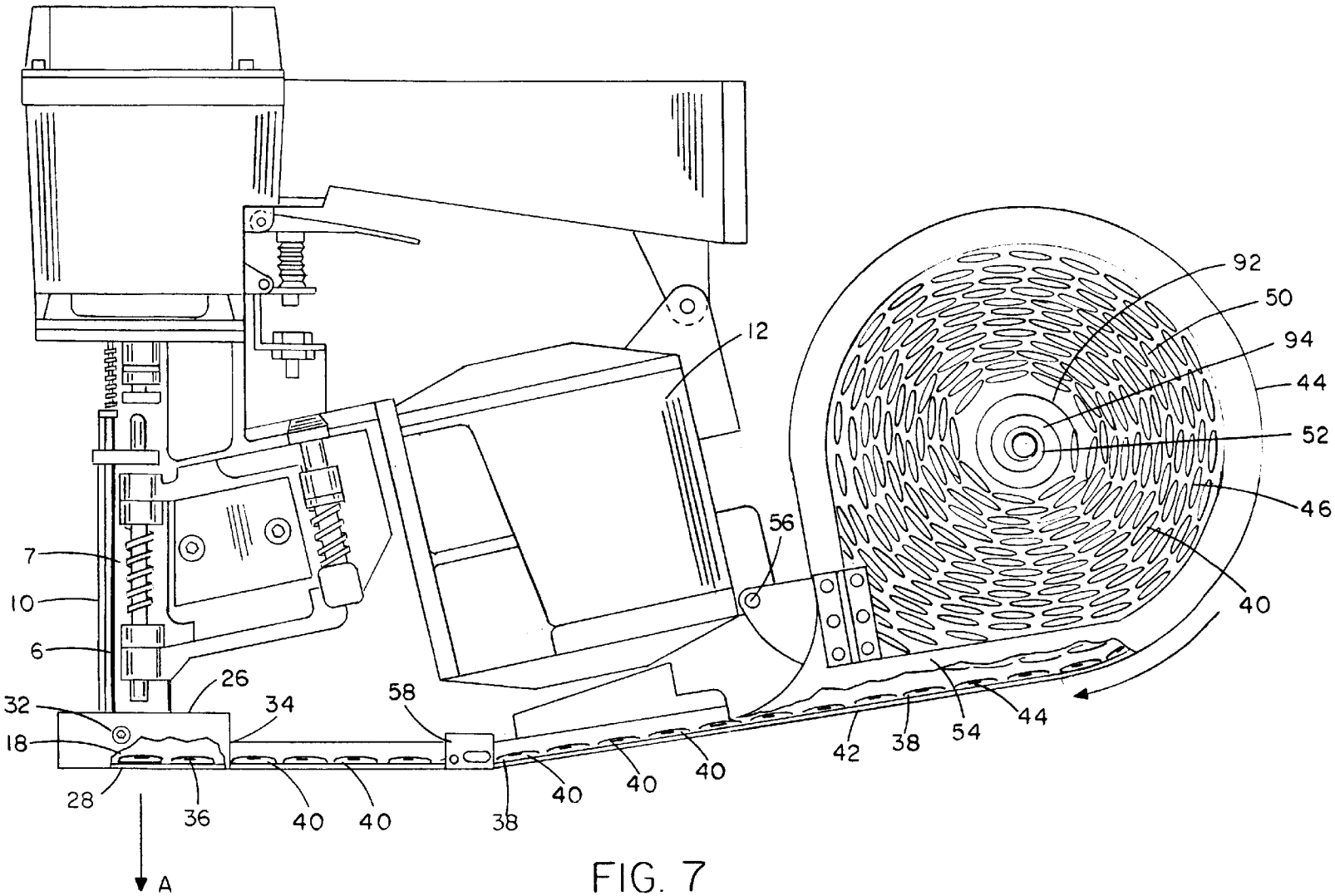
FIG. 7 is a side elevational view of a fastener cap feeder assembly in accordance with the present invention attached to the fastener driver of FIG. 1 and with a second alternate embodiment fastener cap moving mechanism.

The present invention provides a fastener cap feeder assembly shown generally as 24 in FIGS. 5–7 for use with a fastener driver 2, which utilizes positioning means such as a nose piece 26 to receive and support a fastener cap 18 in a position immediately beneath nose 6 of fastener driver 2, such that when a nail 4 is ejected from nose 6, the shaft 20 of nail 4 is driven through the fastener cap 18 and through sheet material 16 into substrate 8. Referring to FIGS. 2 and 3, in the preferred embodiment, the fastener cap 18 is somewhat disc-like with a substantially circular perimeter, but the fastener cap 18 may have a perimeter configured in any number of non-circular shapes. Preferably, the fastener cap 18 is provided with a central opening 22 having a diameter that is substantially the same as or slightly less than a diameter of the shaft 20 of nail 4, but the diameter of opening 22 may be slightly greater than the diameter of the shaft 20 of nail 4. On the other hand, it is possible to omit the central opening 22 entirely, so long as nail 4 is ejected and driven with sufficient force to drive nail 4 through fastener cap 18 and sheet material 16 into substrate 8. Opening 22 has a diameter that is less than the diameter of head 28 of nail 4, such that when shaft 20 of nail 4 is driven through opening 22 (or through fastener cap 18, if no opening is provided) and through sheet material 16 into substrate 8, head 28 of nail 4 securely fixes fastener cap 18 to the sheet material 16 between head 28 of nail 4 and substrate 8 as shown in FIG. 4.

Figure 8:
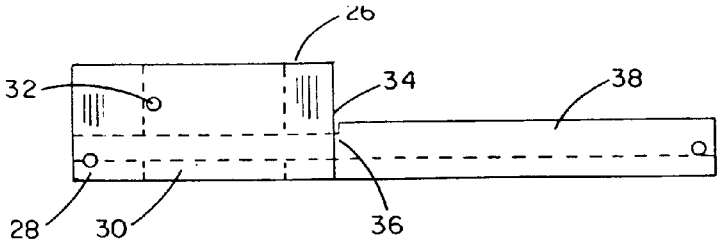
FIG. 8 is a side elevational view of the nose piece of the feeder cap assembly of FIGS. 5, 6 and 7.
Figure 9:
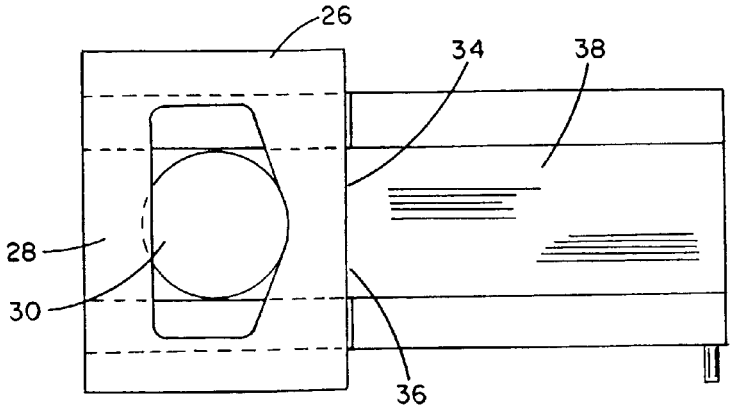
FIG. 9 is a top plan view of the nose piece of FIG. 8.
Figure 11:
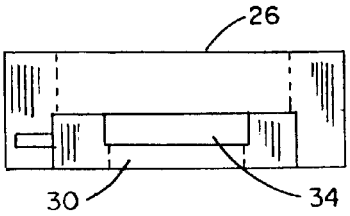
FIG. 11 is an end view of the nose piece of FIG. 8.
Figure 10:
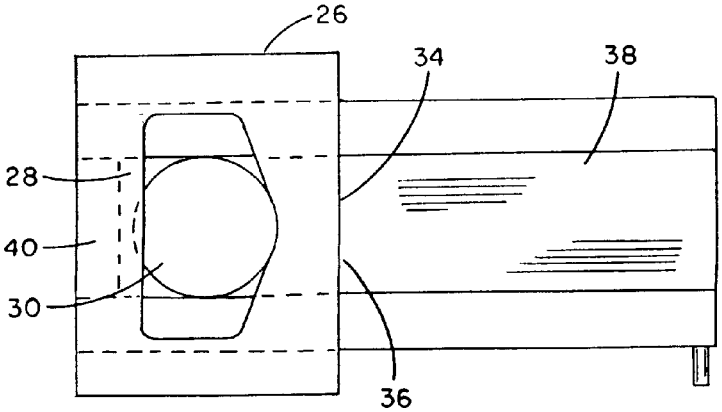
FIG. 10 is a top plan view of the nose piece of FIG. 8 shown with a stop.

The nose piece 26 is attached to spring biased assembly 10 of fastener driver 2 proximate nose 6, such that nose piece 26 is interposed between nose 6 of fastener driver 2 and the sheet material 16 to be fastened to substrate 8. Thus, in order to actuate the fastener driver 2 for ejecting and driving nail 4, the spring biased assembly 10 of fastener driver 2 is pressed inwardly by pressing the nose piece 26 against sheet material 16 rather than by pressing spring biased assembly 10 directly against sheet material 16. Referring to FIGS. 8–10, the nose piece 26 is provided with a support member 28 for supporting the fastener cap 18, such that fastener cap 18 is disposed in a plane substantially perpendicular to a path indicated by arrow direction "A" of nail 4 to be ejected and driven from nose 6 with opening 22 in substantial alignment with path "A" of nail 4. The nose piece 26 is also provided with an aperture 30, as shown in FIGS. 8–10, to permit passage of the shaft 20 of nail 4 when the nail 4 is ejected from nose 6 of the fastener driver 2. Aperture 30 is dimensioned to likewise permit passage of fastener cap 18 when nail 4 is ejected and shaft 20 is driven through the fastener cap 18 and sheet material 16 into substrate 8. Thus, when nail 4 is ejected, fastener cap 18 is driven from its position supported by support member 28 and carried with ejected nail 4. Preferably, nose piece 26 may be pivotably fastened to spring biased assembly 10 to enable pivoting of nose piece 26 on a pivot axis 32 relative to nose 6 of fastener driver 2 in a direction away from fastener driver 2 for access to the area between nose 6 and support member 28, for example, in the case of a malfunction such as a jam.

Figure 12:
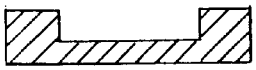
FIG. 12 is a cross sectional view of the track of the fastener cap feeder assembly of FIGS. 5, 6, and 7.

When fastener cap 18 is driven with nail 4 from its position supported on support member 28 in nose piece 26, it must be replaced by one of a plurality of succeeding fastener caps 40 lying in a fastener cap guide means. For this purpose, nose piece 26 is provided with an open side 34 communicating with an end 36 of a fastener cap guide means such as track 38 to permit passage of succeeding fastener caps 40 from track 38 to nose piece 26. Nose piece 26 may be provided with a stop 41, as shown in FIG. 10, to arrest movement of succeeding fastener caps 40 in a position of fastener cap 18 supported on support member 28, or stop 41 may be omitted as shown in FIGS. 8 and 9. Stop 41, as shown in FIG. 10, is arranged in nose piece 26 to arrest movement of succeeding fastener caps 40 in a position of fastener cap 18 supported on support member 28 such that fastener cap 18 is disposed in a plane substantially perpendicular to barrel 7 of fastener driver 2 and path "A" of ejected nail 4 and with opening 22 substantially aligned with path "A" of ejected nail 4. In the preferred embodiment, track 38 is elongate and defined generally as a channel with a somewhat U-shaped cross section and an open top as shown in FIG. 12. Track 38 extends somewhat perpendicular to path "A" of nail 4 with one end 36 communicating with the open side 34 of nose piece 26 and an opposite end 42 communicating with a fastener cap supply holding means such as magazine 44 as shown in FIGS. 5–7. The magazine 44 is canister-like with portions defining an interior 46 for receiving and holding a supply of fastener caps 50 and an access opening 52 for inserting the supply of fastener caps 50. The magazine 44 also has portions defining an opening 54 which permits passage of succeeding fastener caps 40 from the supply of fastener caps 50 held in magazine 44 through opening 54 to the end 42 of track 38 to be guided by track 38 to its other end 36 for passage to nose piece 26. In the preferred embodiment, magazine 44 can be pivotably attached to fastener driver 2 to permit pivotal or swinging movement of magazine 44 and a swing-away section of track 38 on a pivot axis 56 in a direction away from fastener driver 2 to enable access to areas of fastener driver 2 such as magazine 12 of fastener driver 2. For this purpose, track 38 can be provided with a releaseable coupling 58, as shown in FIG. 7, to enable such swinging movement.

In order to move one of the plurality of succeeding fastener caps 40 to nose piece 26 from track 38, a fastener cap moving means is provided which is intermittently operable in response to actuation of fastener driver 2 to incrementally move one of the succeeding fastener caps 40 from track 38 to nose piece 26. In a preferred embodiment, the fastener cap moving means takes the form of a fastener cap moving mechanism 58 associated with track 38 shown somewhat schematically in FIG. 5. Fastener cap moving mechanism 58 makes use of feed trigger 60 disposed proximate the open top of track 38 with an end 72 extending through the open top of track 38 into the channel defined by the substantially U-shaped cross section of track 38. Feed trigger 60 is movable between a forward position toward end 36 of track 38 and a rearward position away from end 36 of track 38 and is normally spring biased to the forward position. Feed trigger 60 is connected to an end 62 of feed lever 64 which has an opposing end 66 pivoted to fastener driver 2. Feed lever 64 is pivotable in response to movement of link 68 connected to spring biased assembly 10 of fastener driver 2, which movement is transmitted to feed lever 66 through cam roller 70 of link 68. When spring biased assembly 10 of fastener driver 2 is pressed inwardly toward nose 6 of fastener driver 2 by pressing nose piece 26 against sheet material 16 to actuate fastener driver 2, link 68 connected to spring biased assembly 10 acts on feed lever 64 through cam roller 70. In turn, feed lever 64 connected to feed trigger 60 acts on feed trigger 60 to move feed trigger 60 from its normally disposed forward position to the rearward position away from end 36. In order to enable rearward movement of feed trigger 60 without moving one of the succeeding fastener caps 40 rearward with it, preferably, feed trigger 60 is arranged to allow it to be pivoted upward away from track 38 toward end 36 to ride over the upper surface of a succeeding fastener cap 40 as feed trigger 60 is moved to its rearward position. Further, preferably feed trigger 60 is spring biased to pivot downward after riding over the succeeding fastener cap 40 in order for end 72 of feed trigger 60 to engage the succeeding fastener cap 40. Upon actuation of fastener driver 2, nail 4 is ejected and driven from nose 6, in turn driving fastener cap 18 from nose piece 26. After actuation of fastener driver 2, spring biased assembly 10 is allowed to return to its normally disposed spring biased position away from nose 6 of fastener driver 2, whereupon cam roller 70 of link 68 no longer acts on feed lever 64, and feed trigger 60 is allowed to return to its normally disposed spring biased forward position. As feed trigger 60 moves to its forward position, end 72 of feed trigger 60 moves the succeeding fastener cap 40 forward toward end 36 of track 38 an incremental distance equal to about or slightly greater than the diameter of the succeeding fastener cap 40.

Figure 13:
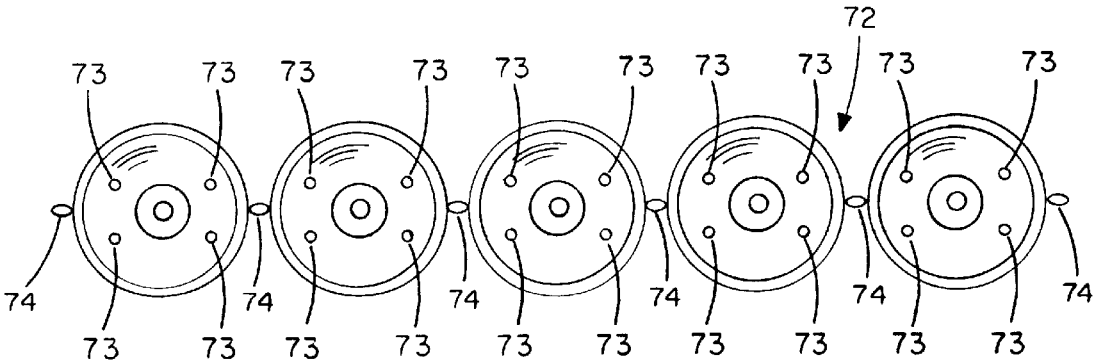
FIG. 13 is a top plan view of an assemblage of feeder caps arranged in a strip for use in the fastener cap feeder assembly of FIGS. 5, 6, and 7.

Preferably, the supply of fastener caps 50 held in magazine 44 is provided in the form of an assemblage of fastener caps 72 held in a fixed relationship to one another as shown in FIG. 13. In the preferred embodiment, the assemblage of fastener caps 72 takes the form of a plurality of fastener caps releaseably connected to one another in a continuous strip by at least one breakable member 74 disposed on a marginal edge of each fastener cap. Alternatively, the assemblage of fastener caps 72 may held in fixed relationship to one another by releasably attaching each to a carrier member in the form of a release strip rather than connecting the fastener caps directly to one another. Referring to FIGS. 2–4, in the preferred embodiment, each fastener cap 18 has a generally concave bottom surface 76 and a generally convex upper surface 78 with a substantially centrally disposed recess 80 formed in upper surface 78 to receive the head 28 of nail 4 when shaft 20 of nail 4 is driven through opening 22 of fastener cap 18. Opening 22 of fastener cap 18 is likewise substantially centered within recess 80 to receive shaft 20 of nail 4 when nail 4 is ejected and driven from nose 6 of fastener driver 2. Referring to FIG. 5, feed trigger 60 is operable to be moved to its rearward position upon pressing inwardly on spring biased assembly 10 in order to actuate fastener driver 2. Upon actuation of fastener driver 2, shaft 20 of nail 4 is driven through opening 22 of fastener cap 18 with sufficient force to break breakable member 74 and separate fastener cap 18 from the assemblage of fastener caps 72, and fastener cap 18 is carried from support member 28 through aperture 30 by nail 4. After actuation, spring assembly 10 is allowed to return its normally disposed position, whereupon feed trigger 60 is likewise allowed to return to its spring biased forward position, thereby moving one of the succeeding fastener caps 40 forward an incremental distance toward end 36 of track 38 and thus moving the entire assemblage of fastener caps 72 a like distance forward in track 38 toward end 36. It may be desirable to provide individual fastener caps 40 of the assemblage of fastener caps 72 with one or more indentations or openings 73, as shown in FIG. 13, which can be engaged by feed trigger 60 as it returns to its forward position. Thus, feed mechanism 58 is operable in response to such actuation to move the assemblage of fastener caps 72 toward nose piece 26 an incremental distance that is sufficient to move one of the succeeding fastener caps 40 from a position in track 38 adjacent end 36 through open side 34 of nose piece 26 to a position supported on support member 28. Accordingly, with each actuation of fastener driver 2, the assemblage of fastener caps 72 is moved an incremental distance in track 38 toward nose piece 26 and away from magazine 44, such that succeeding fastener caps 40 are continually drawn from the supply of fastener caps 50 in magazine 44. When the supply of fastener caps 50 is fully drawn from magazine 44, a fresh supply can be inserted in interior 46 of magazine 44 through access opening 52.

The fastener cap moving means may also take the form of an alternative fastener cap moving mechanism shown somewhat schematically as 82 in FIG. 6. Fastener cap moving mechanism 82 makes use of a feed finger 84 disposed proximate the open top of track 38 with an end 86 extending through the open top of track 38 into the channel defined by the substantially U-shaped cross section of track 38. Feed finger 84 is movable between a forward position toward end 36 of track 38 and a rearward position away from end 36 of track 38 by means of a double action pneumatic piston 87 actuated by switch 88. Feed finger 84 is mounted on pneumatic piston 87 and is normally held in the forward position by extension of piston 87 toward end 36. Switch 88 is operable in response to movement of rod 90 connected to spring biased assembly 10 of fastener driver 2. When spring biased assembly 10 is pressed inwardly toward nose 6 of fastener driver 2 by pressing nose piece 26 against sheet material 16 to actuate fastener driver 2, rod 90 connected to spring biased assembly 10 operates switch 88 to actuate piston 87 to retract in a direction away from end 36, thereby moving feed finger 84 from its normally disposed forward position to its rearward position away from end 36. Likewise, in order to enable rearward movement of feed finger 84 without moving one of the succeeding fastener caps 40 with it, preferably feed finger 84 is arranged to allow it to be pivoted upward away from track 38 toward end 36 to ride over the upper surface of a succeeding fastener cap 40 as feed finger 84 is moved to its rearward position. Further, preferably, feed finger 84 is spring biased to pivot downward after riding over the succeeding fastener cap 40 in order for end 86 to engage the succeeding fastener cap 40. Upon actuation of fastener driver 2, nail 4 is ejected and driven from nose 6, in turn driving fastener cap 18 from nose piece 26. After actuation of fastener driver 2, spring biased assembly 10 is allowed to return to its normally disposed position away from nose 6 of fastener driver 2, whereupon rod 90 operates switch 88 to actuate piston 87 to its extended position, thereby returning feed finger 84 to its normally disposed forward position. As feed finger 84 moves toward its forward position, end 86 of feed finger 84 extending through the open top of track 38 moves the succeeding fastener cap 40 forward toward end 36 of track 38 an incremental distance equal to about or slightly greater than the diameter of the fastener cap, thus moving the entire assemblage of fastener caps 72 a like distance forward in track 38 toward end 36. Likewise, it may be desirable to provide individual fastener caps 40 with indentations or openings 73, as shown in FIG. 13, which can be engaged by feed trigger 84 as it moves toward its forward position. Also likewise, with each actuation of fastener driver 2, the assemblage of fastener caps 72 is moved an incremental distance in track 38 toward nose piece 26 and away from magazine 44, such that one of the succeeding fastener caps 40 is moved from track 38 to nose piece 26.

Preferably, the assemblage of fastener caps 72 is held in canister-like magazine 44 in the form of a plurality of fastener caps releasably connected to one another in a continuous strip which can be wound about a central axis in concentric layers with an inner end disposed at the center and an outer end which is threaded through opening 54 of magazine 44 to end 42 of track 38. The fastener cap moving means may also take the form of fastener cap moving mechanism 92 shown somewhat schematically in FIG. 7. Fastener cap moving mechanism 92 makes use of a clock-type winding spring shown schematically as 94 associated with magazine 44 which engages the assemblage of fastener caps 72 held in magazine 44. Spring 94 can be manually wound such that as it subsequently unwinds, it urges the assemblage of fastener caps 72 to rotate relative to magazine 44, thereby urging the outer end of the assemblage 72 forward in track 38 toward nose piece 26 until forward movement of the assemblage 72 is arrested by stop 41 of nose piece 26 with a fastener cap 18 supported on support member 28. When fastener driver 2 is actuated to eject a nail 4 from nose 6, thereby driving fastener cap 18 from nose piece 26, spring 94 acting on the assemblage of fastener caps 72 held in magazine 44 urges the assemblage of fastener caps 72 forward in track 38, thereby moving a succeeding fastener cap 40 forward from track 38 to nose piece 26 a distance about equal to or slightly greater than the diameter of the fastener cap until its forward movement is arrested by stop 41 of nose piece 26.

With respect to the descriptions set forth above, optimum dimensional relationships of parts of the invention (to include variations and size) materials, shape, form, function and manner of operation, assembly and use) are deemed readily apparent and obvious to those skilled in the art, and all equivalent relationships to those illustrated in the drawings and described in the specification are intended to be encompassed. The foregoing is considered as illustrative only of the principal of the invention. Since numerous complications and changes will readily occur to those skilled in the art, it is not intended to limit the invention to the exact construction and operation shown and described, and all simple modifications and equivalents falling within the scope of the appended claims are deemed within the present inventive concept.

What is claimed is:

1. A fastener driver cap feeder assembly, comprising:

positioning means adapted to receive and support a fastener cap proximate a nose of a fastener driver;

guide means communicating with the positioning means adapted to direct succeeding fastener caps to the positioning means;

holding means communicating with the guide means adapted to hold a supply of succeeding fastener caps; and moving means associated with one of the guide means and the holding means and adapted to move the succeeding fastener caps from the supply of succeeding fastener caps held in the holding means from the holding means to the positioning means; and wherein said fastener caps are held in a fixed relationship to one another and adapted to be held in the fastener cap holding means and to be moved by the fastener cap moving means through the fastener cap guide means to the fastener cap positioning means.

2. The fastener driver cap feeder assembly of claim 1, wherein the positioning means comprises a nose piece adapted to be attached to the fastener driver, and the nose piece includes portions defining a support member adapted to support the fastener cap.

3. The fastener driver cap feeder assembly of claim 2, wherein the nose piece has portions defining an aperture adapted to permit passage of a fastener driven by the fastener driver through the fastener cap and to permit passage of the fastener and the fastener cap to a workpiece.

4. The fastener driver cap feeder assembly of claim 3, wherein the nose piece has an open side communicating with the guide means adapted to permit passage of the succeeding fastener caps from the guide means to the nose piece.

5. The fastener driver cap feeder assembly of claim 4, wherein the nose piece has a stop adapted to arrest movement of the succeeding fastener caps.

6. The fastener driver cap feeder assembly of claim 1, wherein the guide means comprises a track having a first end communicating with the holding means adapted to permit passage of the succeeding fastener caps to the track and a second end communicating with the positioning means adapted to permit passage of the succeeding fastener caps from the track to the positioning means.

7. The fastener driver cap feeder assembly of claim 6, wherein the track includes a swing-away section articulated for pivotal movement of the swing-away section adapted to permit access to the fastener driver.

8. The fastener driver cap feeder assembly of claim 7, wherein the track includes a releasable coupling enabling the pivotal movement of the swing-away section.

9. The fastener driver cap feeder assembly of claim 8, wherein the track is elongate and defined generally as a channel with an open top.

10. The fastener driver cap feeder assembly of claim 1, wherein the holding means comprises a magazine having portions defining an interior adapted to receive and hold the supply of succeeding fastener caps and having portions defining an opening communicating with the guide means adapted to permit passage of the succeeding fastener caps from the magazine to the guide means.

11. The fastener driver cap feeder assembly of claim 10, wherein the magazine has an access opening to the interior of the magazine adapted for inserting the supply of succeeding fastener caps.

12. The fastener driver cap feeder assembly of claim 1, wherein the moving means comprises an intermittently operable moving mechanism associated with one of the guide means and the holding means and adapted to operate in response to actuation of the fastener driver to incrementally move the succeeding fastener caps from the guide means to the positioning means.

13. The fastener driver cap feeder assembly of claim 12, wherein the moving mechanism is associated with the guide means and includes a feed trigger extending at least partly into the guide means and spring biased to a forward position toward the positioning means and movable to a rearward position away from the positioning means, and the moving mechanism is adapted to be operable to move the feed trigger to the rearward position to engage one of the succeeding fastener caps in response to actuation of the fastener driver and thereafter to allow the feed trigger to return to the forward position to incrementally move the succeeding fastener caps toward the positioning means.

14. The fastener driver cap feeder assembly of claim 12, wherein the moving mechanism is associated with the holding means and includes a spring disposed in the holding means urging in a direction toward the guide means and adapted to urge the supply of succeeding caps held in the holding means toward the guide means and to incrementally move the succeeding fastener caps toward the positioning means in response to actuation of the fastener driver.

15. The fastener driver cap feeder assembly of claim 2, wherein the guide means comprises a track having a first end communicating with the holding means adapted to permit passage of the succeeding fastener caps from the holding means to the track and a second end communicating with the nose piece adapted to permit passage of the succeeding fastener caps from the track to the nose piece.

16. The fastener driver cap feeder assembly of claim 2, wherein the holding means comprises a magazine having portions defining an interior adapted to receive and hold the supply of succeeding fastener caps and having portions defining an opening communicating with the guide means adapted to permit passage of the succeeding fastener caps from the magazine to the guide means.

17. The fastener driver cap feeder assembly of claim 2, wherein the moving means comprises an intermittently operable mechanism associated with one of the guide means and the holding means adapted to operate in response to actuation of the fastener driver to incrementally move the succeeding fastener caps from the guide means to the nose piece.

18. The fastener driver cap feeder assembly of claim 6, wherein the holding means comprises a magazine having portions defining an interior adapted to receive and hold the supply of succeeding fastener caps and having portions defining an opening communicating with first end of the track adapted to permit passage of the succeeding fastener caps from the magazine to the track.

19. The fastener driver cap feeder assembly of claim 6, wherein the moving means comprises an intermittently operable mechanism associated with one of the track and the holding means and adapted to operate in response to actuation of the fastener driver to incrementally move the succeeding fastener caps from the track to the nose piece.

20. The fastener driver cap feeder assembly of claim 10, wherein the moving means comprises an intermittently operable mechanism associated with the one of the guide means and the holding means and adapted to operate in response to actuation of the fastener driver to incrementally move the succeeding fastener caps from the guide means to the nose piece.

21. The fastener driver cap feeder assembly of claim 15, wherein the holding means comprises a magazine having portions defining an inteior adapted to receive and hold the supply of succeeding fastener caps and having portions defining an opening communicating with the track adapted to permit passage of the succeeding fastener caps from the magazine to the track.

22. The fastener driver cap feeder assembly of claim 15, wherein the moving means comprises an intermittently operable moving mechanism associated with one of the track and the magazine adapted to operate in response to actuation of the fastener driver to incrementally move the succeeding fastener caps from the track to the nose piece.

23. The fastener driver cap feeder assembly of claim 22, wherein the holding means comprises a magazine having portions defining an interior adapted to receive and hold the supply of succeeding fastener caps and having portions defining an opening communicating with the track adapted to permit passage of the succeeding fastener caps from the magazine to the track.

24. The fastener driver cap feeder assembly of claim 23, wherein the nose piece has portions defining an aperture adapted to permit passage of a fastener driven by the fastener driver through the fastener cap and to permit passage of the fastener and the fastener cap to a workpiece.

25. The fastener driver cap feeder assembly of claim 24, wherein the nose piece has an open side communicating with the second end of the track adapted to permit passage of the succeeding fastener caps from the track to the nose piece.

26. The fastener driver cap feeder assembly of claim 25, wherein the moving mechanism is associated with the track and includes a feed trigger extending at least partly into the track and spring biased to a forward position toward the nose piece and movable to a rearward position away from the nose piece, and the moving mechanism is adapted to be operable to move the feed trigger to the rearward position to engage one of the succeeding fastener caps in response to actuation of the fastener driver and thereafter to allow the feed trigger to return to the forward position to incrementally move the succeeding fastener caps toward the nose piece.

27. The fastener driver cap feeder assembly of claim 26, wherein the nose piece has a stop adapted to arrest movement of the succeeding fastener caps.

28. The fastener driver cap feeder assembly of claim 27, wherein the track includes a swing-away section articulated for swinging movement of the swing-away section adapted to permit access to the fastener driver.

29. The fastener driver cap feeder assembly of claim 28, wherein the track includes a releaseable coupling enabling the swinging movement of the swing-away section.

30. The fastener driver cap feeder assembly of claim 29, the track is elongate and defined generally as a channel with an open top.

31. The fastener driver cap feeder assembly of claim 30, wherein the magazine has an access opening to the interior of the magazine adapted for inserting the supply of succeeding fastener caps.

32. The fastener driver cap feeder assembly of claim 25, wherein the moving mechanism is associated with the track and includes a feed finger connected to a pneumatic piston and extending at least partly into the track and movable with the piston between a forward position toward the nose piece and a rearward position away from the nose piece, and the moving mechanism is adapted to be operable to move the piston and feed finger to the rearward position to engage one of the succeeding fastener caps in response to actuation of the fastener driver and thereafter to return the piston and feed finger to the forward position to incrementally move the succeeding fastener cap toward the nose piece.

33. The fastener driver cap feeder assembly of claim 32, wherein the nose piece has a stop adapted to arrest movement of the succeeding fastener caps.

34. The fastener driver cap feeder assembly of claim 33, wherein the track includes a swing-away section articulated for swinging movement of the swing-away section adapted to permit access to the fastener driver.

35. The fastener driver cap feeder assembly of claim 34, wherein the track includes a releaseable coupling enabling the swinging movement of the swing-away section.

36. The fastener driver cap feeder assembly of claim 35, wherein the track is elongate and defined generally as a channel with an open top.

37. The fastener driver cap feeder assembly of claim 36, wherein the magazine has an access opening to the interior of the magazine adapted for inserting the supply of succeeding fastener caps.

38. The fastener driver cap feeder assembly of claim 25, wherein the moving mechanism is associated with the magazine and includes a spring disposed in the magazine urging in a direction toward the track and adapted to urge the supply of succeeding fastener caps held in the magazine toward the track and to incrementally move the succeeding fastener caps toward the nose piece in response to actuation of the fastener driver.

39. The fastener driver cap feeder assembly of claim 38, wherein the nose piece has a stop adapted to arrest movement of the succeeding fastener cap.

40. The fastener driver cap feeder assembly of claim 39, wherein the track includes a swing-away section articulated for swinging movement of the swing-away section adapted to permit access to the fastener driver.

41. The fastener driver cap feeder assembly of claim 40, wherein the track includes a releaseable coupling enabling the swinging movement of the swing-away section.

42. The fastener driver cap feeder assembly of claim 41, wherein the track is elongate and defined generally as a channel with an open top.

43. The fastener driver cap feeder assembly of claim 42, wherein the magazine has an access opening to the interior of the magazine adapted for inserting the supply of succeeding fastener caps.

44. A fastener driver cap feeder assembly, comprising:

a fastener driver having a barrel with a central axis and a nose;

a nose piece disposed proximate the nose and adapted to receive a fastener cap, the nose piece including portions defining a support member disposed in a plane substantially perpendicular to the central axis of the barrel and adapted to support the fastener cap, and the nose piece including portions defining an aperture adapted to permit passage of a fastener driven from the fastener driver through the fastener cap and to permit passage of the fastener and the fastener cap to a workpiece;

guide means communicating with the nose piece adapted to direct succeeding fastener caps to the nose piece;

holding means communicating with the guide means adapted to hold a supply of the succeeding fastener caps; and moving means associated with one of the guide means and the holding means adapted to move the succeeding fastener caps to the nose piece.

* * * * *

UNITED STATES PATENT AND TRADEMARK OFFICE

CERTIFICATE OF CORRECTION

PATENT NO : 5,947,362

DATED : September 7, 1999

INVENTOR(S) : Allan T Omli

It is certified that error appears in the above-identified patent and that said Letters Patent is hereby corrected as shown below:

Col. 14, line 24
replace "25"
with --23--.

Col. 14, line 56
replace "25"
with --23--.

Signed and Sealed this

Twelfth Day of September, 2000

*Attest:*

Q. TODD DICKINSON

*Attesting Officer*

*Director of Patents and Trademarks*